United States Patent [19]

Kang

[11] Patent Number: 5,022,529

[45] Date of Patent: Jun. 11, 1991

[54] CASING FOR COMPACT

[75] Inventor: Seong I. Kang, Kwangmyong, Rep. of Korea

[73] Assignee: Pacific Chemical Co., Ltd., Seoul, Rep. of Korea

[21] Appl. No.: 523,989

[22] Filed: May 16, 1990

[30] Foreign Application Priority Data

Sep. 25, 1989 [KR] Rep. of Korea ..... 89-13866

[51] Int. Cl.[5] ..... B65D 69/00; B65D 43/16

[52] U.S. Cl. ..... 206/581; 220/337; 220/338; 220/343

[58] Field of Search ..... 206/581; 220/337, 338, 220/342, 343

[56] References Cited

U.S. PATENT DOCUMENTS

| | | | |
|---|---|---|---|
| 2,200,399 | 5/1940 | Primas | 220/343 |
| 2,960,254 | 11/1960 | Kiba | 220/338 |
| 4,693,392 | 9/1987 | Contreras, Sr. | 220/343 |

FOREIGN PATENT DOCUMENTS

| | | | |
|---|---|---|---|
| 445741 | 4/1968 | Switzerland | 220/337 |

*Primary Examiner*—William I. Price
*Attorney, Agent, or Firm*—Helfgott & Karas

[57] ABSTRACT

A casing for compact in which the main body of the casing consists of upper and lower bodies, said upper and lower bodies forming pivot retaining bores between them. The pin portions of a lid are pivotally supported in the pivot retaining bores. Thus, the lid is pivotally linked to the main body, thereby providing a strong casing for compact without disjoining of parts or deteriorating of appearance.

6 Claims, 5 Drawing Sheets

CASING FOR COMPACT

FIELD OF THE INVENTION

The present invention relates to a casing for compact, particularly to a casing for compact having improved assembling structure.

BACKGROUND OF THE INVENTION

A "compact" stands for a portable cosmetic container which contains cosmetics, for example, powder, eye shadow or lip color, and cosmetic articles. The compact generally comprises a main body for containing cosmetics and cosmetic articles, and a lid which is pivotally linked to the main body to prevent the contents from contaminating or missing.

FIG. 1A to FIG. 1C show conventional casings for compact now well in use.

The example shown in FIG. 1A is constituted such that an elongated boss 44*a* having a pin retaining bore 44*b* is extending downward from the rear part of a lid 44, and that a recess 41*a* engaging the elongated boss 44*a* is formed at the rear part of a main body 41, and at both shoulders of the recess, pin retaining bores 41*b* corresponding to the pin retaining bore 44*b* of the elongated boss 44*a* are formed, so that, the lid 44 and the main body 41 are pivotally linked to each other by inserting an independent elongated pin 42 into the pin retaining bores 41*b*, 44*b*. In the above mentioned structure, the elongated pin 42 should be tightly inserted in the pin retaining bores 41*b*, 44*b* so as to not to be disjointed. But a relatively large molding allowance of the main body 41 and the lid 44, both of which are generally formed of plastic resin, impedes the easy insertion of the elongated pin 42 into the pin retaining bores 41*b* , 44*b*, and thereby making productivity lowered. Furthermore, the lid 44 cannot perform a smooth pivotal operation relative to the main body in the assembled state.

Another example shown in FIG. 1B is constituted such that pin portions 54*b* are integrally formed at both ends of an elogated boss 54*a* which is formed at the rear of a lid 54, and that splitted grooves 51*b* having a smaller width than the diameter of the pin portions 54*b* are respectively formed at both shoulders of the recess 51*a* of a main body 51, said recess 51*a* being engaged with the elongated boss 54*a*.

At the middle of each splitted groove 51*b*, expanded bores 51*c* having a larger diameter than those of the pin portions 54*b* are provided. The lid 54 is pivotally linked to the main body 51 by inserting the pin portions 54*b* of the lid 54 into the expanded bores 51*c* in which said pin portions are retained, through the splitted grooves 51*b*.

During the assembling procedure in which the pin portions 54*b* enter the corresponding expanded bores 51*c*, accompanied with a forced deformation of the splitted grooves 51*b* by pressing the lid 54 against the main body 51, the pin portions 54*b* are liable to be broken. Moreover, the pin portions 54*b* are not retaind firmly in the assembled state, so they are apt to be disjointed.

The example shown in FIG. 1C is constituted such that bead-like projections 64*b* are integrally formed at both end forces of the elongated boss 64*a* which is formed at the rear of a lid 64, and that grooves 61*b* corresponding to the projections 64*b* are respectively formed at end walls of both shoulders of the recess 61*a* of a main body 61, said recess being engaged with the elongated boss 64*a*.

The projections 64*b* are respectively coupled with the corresponding grooves 61*b* by pressing the lid 64 against the main body 61. This example provides a good productivity due to easy assembling, but when the pressing lid 64, the projections 64 scratches the end walls of the shoulders and deteriorate the appearance of the casing. Further, the lid 64 is liable to be disjointed as it cannot be retained firmly.

SUMMARY OF THE INVENTION

Therefore, it is the object of the present invention to provide a casing for compact which is easy to assemble without requiring precise molding allowance, which has a firm assembled state and cannot be easily disjointed, and has a simple structure requiring no independent parts such as hinge pin.

According to one aspect of the present invention there is provided a casing for compact, comprising a lid having an elongated projection formed at the rear of the lid, the elongated projection including two integral pin portions at both ends; an upper body having a recess for engaging with the elongated projection of the lid, at the rear of the upper body, two shoulders being formed at both sides of the recess, each shoulder including a retaining groove for surrouding a part of the circumference of the pin portion in the assembled state; and a lower body assembled with the upper body to form a casing main body and having projecting pieces, at the end of each of which a retaining groove is provided to form for the pin portion of the lid a pivot retaining bore with the corresponding retaining groove of the upper body in the assembled state.

Therefore, the lid is pre-assembled by setting the pin portions of the elongated projections to the retaining grooves which are formed at the shoulders of the recess of the upper body; then the upper body is assembled with the lower body. Thus, the ends of the projecting pieces abut against the shoulders of the upper body, making it possible for the corresponding retaining grooves there of to form closed pivot retaining bores for pivotally supporting the pin portions.

As the result, the lid and upper and lower body can be assembled even if not molded precisely, and there arise no problem of disengaging the parts as the pin portions of the lid are pivotally supported in the closed pivot retaining bores, and the structure is very strong as all the elements are assembled into an integral assembly. Therefore, it is possible to provide a useful casing for compact with many advantages.

BRIEF DESCRIPTION OF THE DRAWINGS

Other objects, features and advantages of the present invention will be apparent from the following description with reference to the accompanying drawings in which.

DETAILED DESCRIPTION OF THE PREFERRED EMBODIMENTS

Figure 1A:
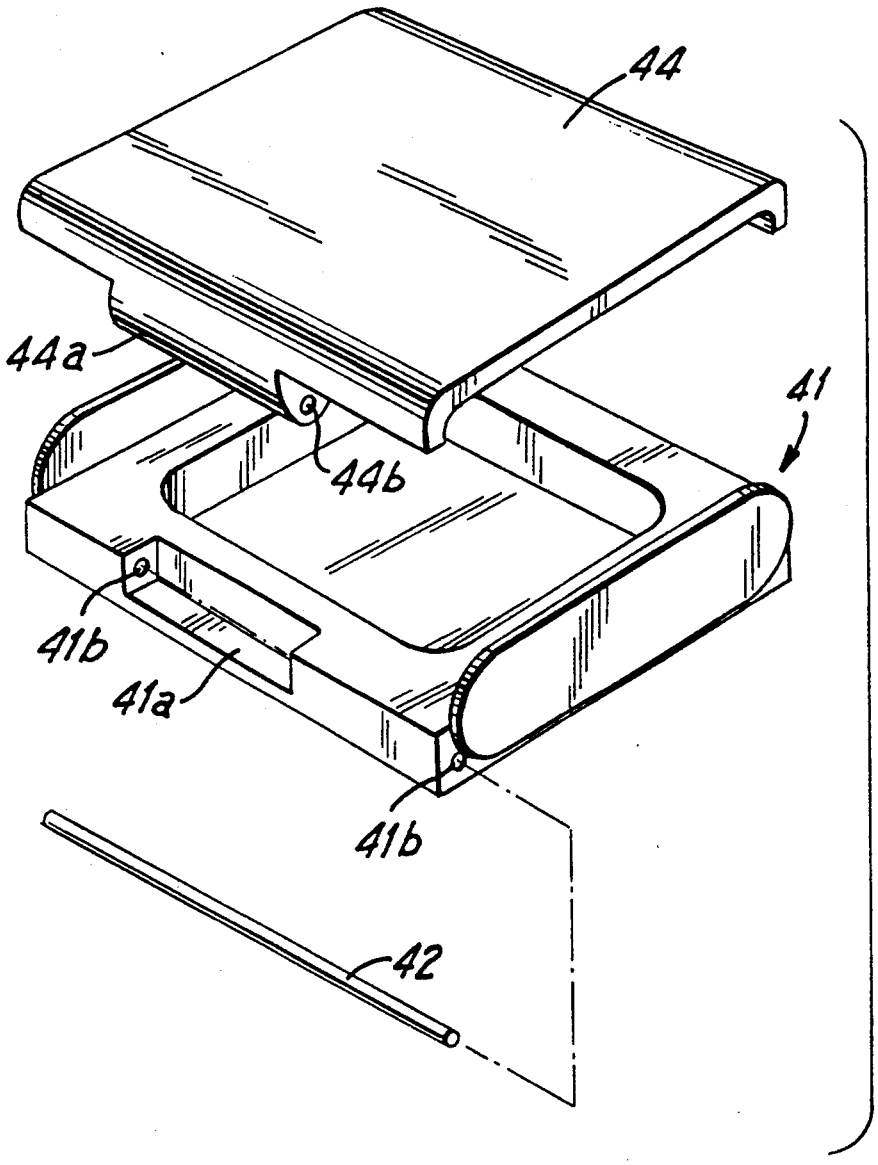
PRIOR ART FIG.1A
FIG. 1A to FIG. 1C are exploded perspective views respectively showing conventional casings for compact.
Figure 1B:
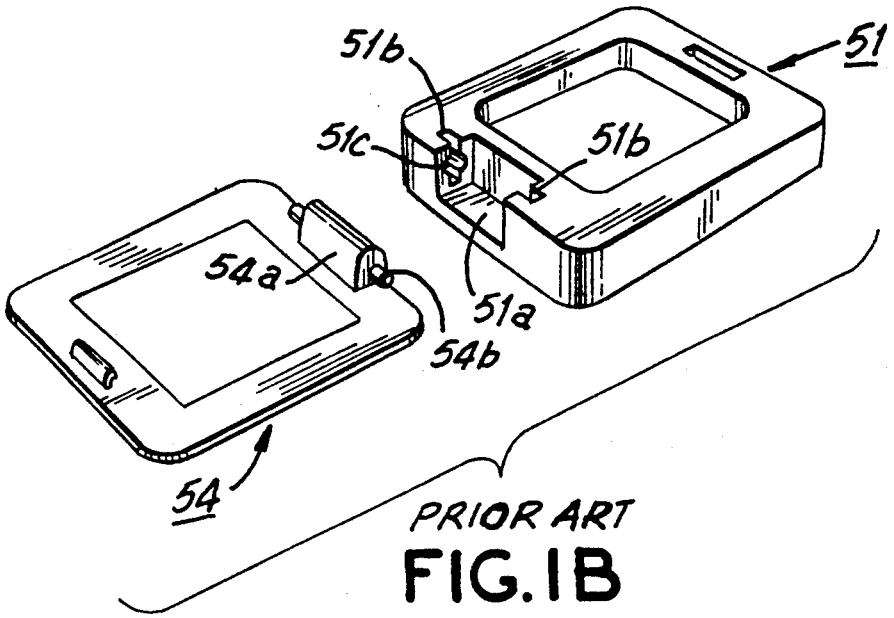
PRIOR ART FIG. 1B
Figure 1C:
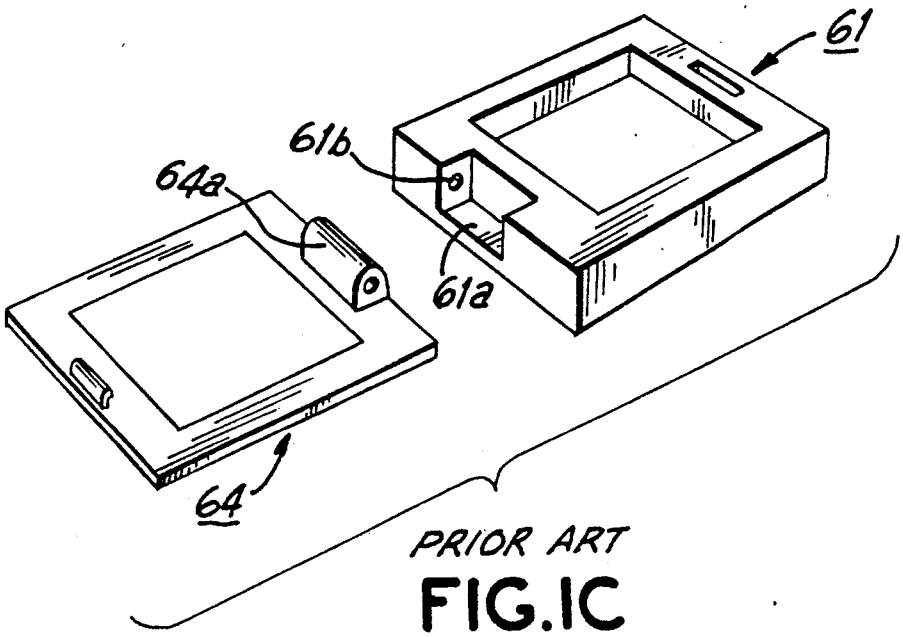
PRIOR ART FIG. 1C
Figure 2:
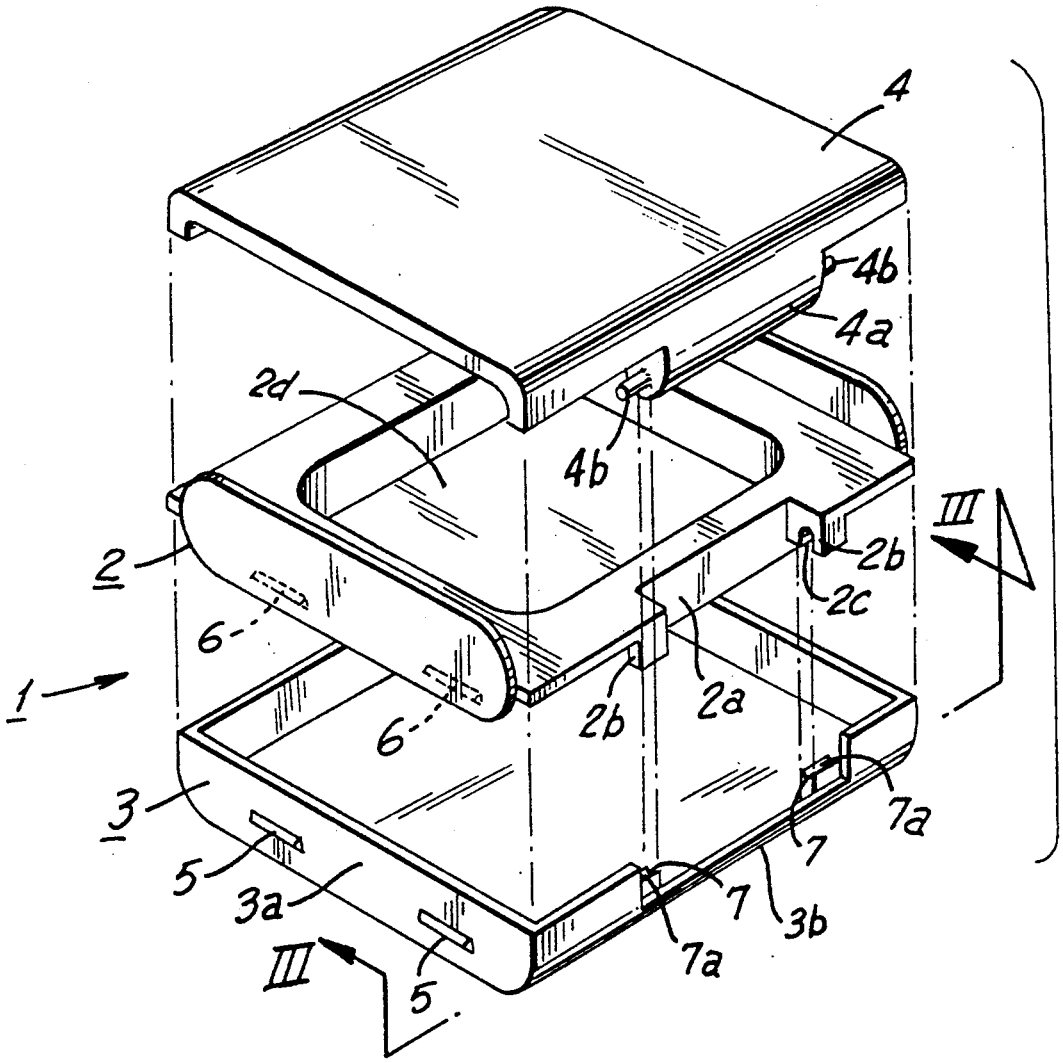
FIG. 2 is an exploded perspective view showing a casing for compact according to the present invention.

In FIG. 2, there is shown one preferred embodiment of the present invention, in which the casing for compact comprises an upper body 2 and a lower body 3, both of which are assembled to form a casing main body 1, and a lid 4 which is to be pivotally linked to the casing body assembly. The upper and lower bodies 2, 3 and the lid 4 are preferably formed of elastic synthetic resin such as plastics.

At the middle of the rear wall of the lid 4, an elongated downwardly extending projection 4*a* having two pin portions 4*b* at both end faces thereof are formed.

A retaining portion 2*d* for receiving contents such as cosmetics and cosmetic articles is formed at the central part of the upper body 2, and in the rear of body 2, a recess 2*a* corresponding to the elongated projection 4*a* of the lid 4 and two shoulders 2*b* extending downward, and being located at each side of the recess, are respectively provided. At shoulders 2*b*, retaining grooves 2*c* are respectively provided for surrounding the part of the circumference of the respective pin portions 4*b* of the lid 4 in the assembled state. The retaining grooves 2*c* shown in FIG. 2 are elongated and U-shaped, and opened in the downward direction, thus preventing the pin portions 4*b* from disjointing except in the opened direction, when engaged with the pin portions 4*b*.

The lower body 3 is surrounded by a side wall 3*a*, which is to be joined with the lower part of the upper body 2. And preferably a cutout 3*b* is formed by removing the rear part of the side wall 3*a*. The width of the cutout 36 corresponds to the distance between the outer ends of the shoulders 2*b* of the upper body 2; thus, the shoulders 2*b*, with the pin portions 4*b* of the lid 4 in their retaining grooves 2*c* of the upper body 2, engage with the cutout 3*b*. At the positions which are located in the inner side of the cutout 3*b* and correspond to those of the retaining grooves 2*c* formed at shoulder 2*b* of the upper body 2, two projecting pieces 7 are provided, which are to be engaged with the corresponding retaining grooves 2*c*. At the upper end of each projecting piece 7, a concave retaining groove 7*a* having substantially the same curvature as that of the U-shaped retaining grooves 2*c* is formed.

More preferably, a plurality of joining projections 5 are provided at outer surface of the side wall 3*a* of the lower body 3, and a plurality of joining grooves 6 each having a size and a shape corresponding to those of the joining projections 5, are positioned at the inner surface of the upper body 2.

The assembling procedures of the above described casing now will be explained.

Figure 3:
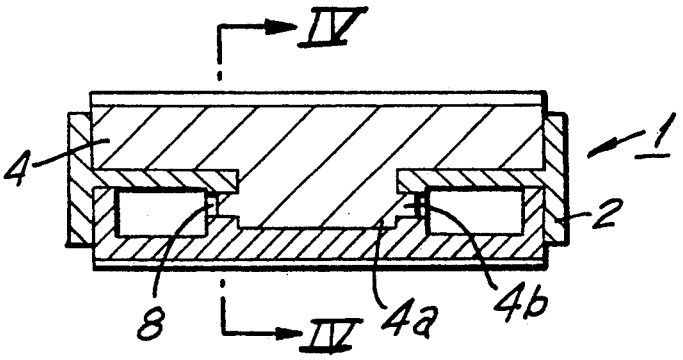
FIG. 3 is a transverse sectional view taken on line III—III in FIG. 2.

Firstly, pin portions 4*b* of the elongated projection 4*a* of the lid 4 are entered into the opened ends of the retaining grooves 2*c* formed at the shoulders 2*b* of upper body 2, and supported thereat. Next, if the upper body 2 is pressed against the lower body 3, the joining projections 5 formed at outer surface of the side wall 3*a* of lower body 3 are elastically joined with the joining grooves 6, thereby assembling the lid 4 with the upper and lower bodies 2, 3 as shown in FIG. 3.

Figure 4:
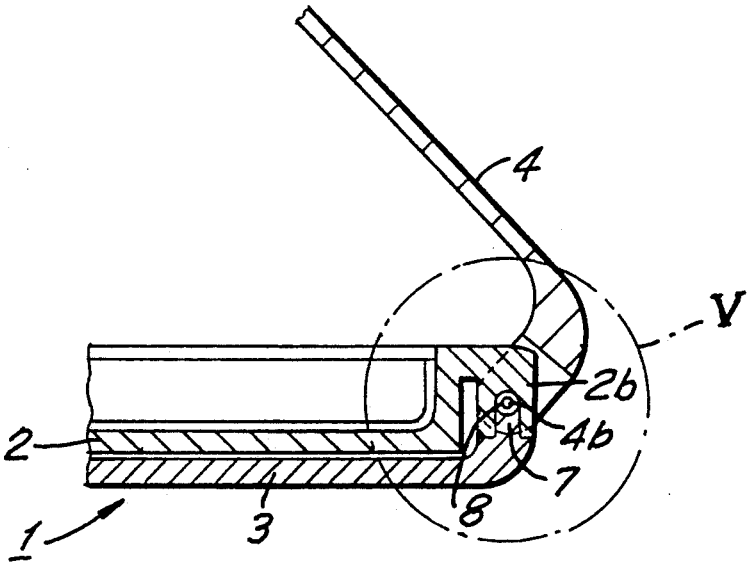
FIG. 4 is a partial longitudinal sectional view of the casing in the assembled state taken on line IV—IV in FIG. 3.
Figure 5C:
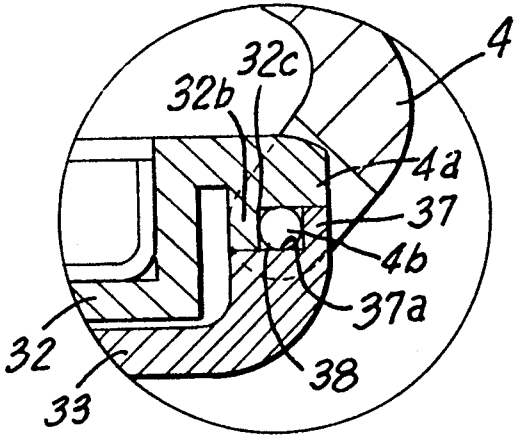
FIG. 5A to FIG. 5C are partial enlarged sectional views of the casings in the assembled state, respectively showing other embodiments of the present invention, with a changeable part V of FIG. 4.
Figure 5B:
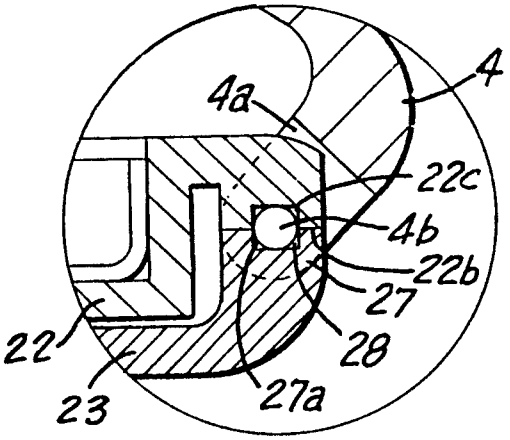
Figure 5A:
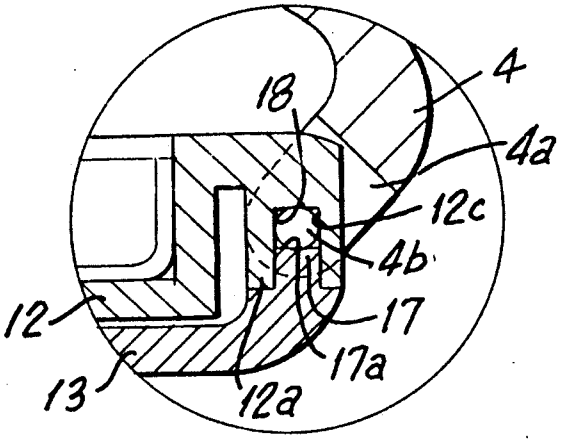

Here, the projecting pieces 7 of the lower body 3 are respectively inserted into the corresponding U-shaped retaining grooves 2*c* of the upper body 2, thus the retaining groove 7*a* of the projecting piece 7 and inner part of the retaining groove 2*c* jointly form a circular closed pivot retaining bore 8. The pin portions 4*b* of the lid 4 are pivotally supported in the corresponding pivot retaining bore 8, thus the lid 4 is pivotally linked to the casing main body 1 formed by upper and lower bodies 2, 3.

in FIG. 5A to FIG. 5C, there are shown other embodiments of the present invention, each of which has polygonal, for example rectangular, pivot retaining bores. In the drawings, the elements corresponding to those shown in FIG. 2 to FIG. 4 are respectively indicated by gradually adding 10.

In another embodiment of the present invention showning in FIG. 5A, rectangular channel shaped retaining grooves 12C are formed at shoulders 12*a* of the upper body 12, and flat faces 17*a* are formed at upper ends of the projecting pieces 17 of the lower body 13, thereby making substantially exact rectangular pivot retaining bores 18 in the assembled state.

In a still another embodiment shown in FIG. 5B, at both shoulders 22*b* of the upper body 22 and upper ends of the projecting pieces 27 of the lower body 23, shallow channel-shaped retaining grooves 22*c*, 27*a* respectively formed, thereby making substantially exact rectangular pivot retaining bores 28 in the assembled state.

In a further embodiment shown in FIG. 5C, L-shaped retaining grooves 32*c* are formed at shoulders 32*b* of the upper body 32, and corresponding reverse L-shaped retaining grooves 37*a* are provided at the upper ends of the projecting pieces 37 of the lower body 33, thereby making substantially exact rectangular pivot retaining bores 38 in the assembled state.

Further, while the upper body 2 and lower body 3 are asembled by joining projections 5 and grooves 6 in the first embodiment, the upper and lower bodies 2, 3 may be fixedly assembled by adhesive, or high-frequency bonding, especially in case the upper and lower bodies 2, 3 are made of plastic resin.

While the invention has been described in its preferred forms, it is to be understood that the description is for illustrative purpose only, and that changes and modifications may be made by those who skilled in the art without departing from the scope and spirit of the following claims.

What is claimed is:

1. A casing for compact comprising:

a lid having an elongated projection formed at the rear of the lid, said elongated projection including two integral pin portions at both ends thereof;

an upper body having a recess for engaging with said elongated projection of the lid at its rear, and two shoulders formed at both sides of said recess, each of said shoulders including a retaining groove for surrounding a part of the circumference of said pin portion in the assembled state; and a lower body being assembled with said upper body to form a casing main body, and having projecting pieces, at the end of each of which a retaining groove is provided, for forming a pivot retaining bore for said pin portion of the lid with said retaining groove of the upper body in assembled state.

2. The casing for compact according to claim 1, wherein said pivot retaining bore is formed in substantially circular shape.

3. The casing for compact according to claim 1, wherein said pivot retaining bore is formed in substantially polygonal shape.

4. The casing compact according to claim 1, wherein at one of said upper body or lower body at least one joining projection is provided, and at remainder of said upper body or lower body at least one groove is provided, and wherein said upper body and said lower body are assembled together by joining said projection and said groove.

5. The casing for compact according to claim 1, wherein said upper body and said lower body are fixedly assembled together by adhesive.

6. The casing for compact according to claim 1, wherein said upper body and said lower body are fixedly assembled together by high-frequency bonding.

* * * * *